US007922226B2

(12) United States Patent
Curley

(10) Patent No.: US 7,922,226 B2
(45) Date of Patent: Apr. 12, 2011

(54) COMPENSATING GRIPPER WITH INDEPENDENT GRIPPER ADJUSTMENT

(75) Inventor: Richard Daniel Curley, Dover, NH (US)

(73) Assignee: Goss International Americas, Inc., Durham, NH (US)

( * ) Notice: Subject to any disclaimer, the term of this patent is extended or adjusted under 35 U.S.C. 154(b) by 0 days.

(21) Appl. No.: 11/483,862

(22) Filed: Jul. 10, 2006

(65) Prior Publication Data

US 2008/0007075 A1 Jan. 10, 2008

(51) Int. Cl.
*B65G 47/90* (2006.01)
*B25J 15/00* (2006.01)

(52) U.S. Cl. ..... 294/106; 294/99.1; 198/803.7; 198/803.9

(58) Field of Classification Search ..... 271/82; 198/803.7, 803.9; 294/86.4, 99.1, 106, 116, 294/118

See application file for complete search history.

(56) References Cited

U.S. PATENT DOCUMENTS

| | | | | | |
|---|---|---|---|---|---|
| 1,216,362 | A | * | 2/1917 | Richards et al. | 294/81.61 |
| 1,534,414 | A | * | 4/1925 | Rogers et al. | 294/86.27 |
| 2,348,741 | A | * | 5/1944 | Jessen | 294/115 |
| 3,125,369 | A | * | 3/1964 | Copping | 294/87.24 |
| 3,363,929 | A | * | 1/1968 | Nelson | 294/88 |
| 4,196,835 | A | | 4/1980 | Schlough | 227/81 |
| 4,482,141 | A | | 11/1984 | Moser | 270/54 |
| 4,730,861 | A | * | 3/1988 | Spencer | 294/86.4 |
| 4,768,428 | A | * | 9/1988 | Silvestrini et al. | 99/551 |
| 5,201,501 | A | * | 4/1993 | Fassler | 269/32 |
| 5,253,910 | A | * | 10/1993 | Perrier | 294/116 |
| 5,871,242 | A | * | 2/1999 | Whitney | 294/16 |
| 6,079,541 | A | * | 6/2000 | Bercelli et al. | 198/377.03 |
| 6,616,139 | B2 | | 9/2003 | Aesch | 271/204 |
| 2005/0225023 | A1 | | 10/2005 | Schlough | 271/69 |

* cited by examiner

*Primary Examiner* — Dean J Kramer
(74) *Attorney, Agent, or Firm* — Davidson, Davidson & Kappel, LLC

(57) ABSTRACT

A gripping device for gripping a printed product including a rotatable first gripper arm having a first gripper pad and a pivot, a rotatable second gripper arm having a second gripper pad and a pivot, a first link connecting the first gripper arm and second gripper arm and a second link having a spring connected to the first link. A method is also provided.

7 Claims, 4 Drawing Sheets

COMPENSATING GRIPPER WITH INDEPENDENT GRIPPER ADJUSTMENT

BACKGROUND

The present invention relates generally to-bookbinding machines and material handling machinery and more particularly to a device for transporting printed products.

U.S. Pat. No. 4,196,835, hereby incorporated by reference herein, discloses an improved collating machine which includes a stitcher assembly which stitches a group of signatures while they are moving. A saddle conveyor travels past a collating station and individual signatures are fed from the collating station onto the conveyor to form the group of collated signatures. The conveyor carries the group of collated signatures through the stitcher assembly which binds the signatures in each group together.

U.S. Pat. No. 4,482,141 discloses a method and device for conveying signatures from a blade chain conveyor supporting the signatures directly at a fold line. The signatures are gripped from above by orbitally-rotating clamping pads, which then transfer the signatures to a belt conveyor perpendicular to the blade chain conveyor.

U.S. Pat. No. 6,616,139 discloses a device for removing printed products, having a fold and being transported uniformly spaced and astraddle by a transport device, that has a rotatingly driven gripping device with controlled gripping elements for gripping one of the printed products by the fold on the transport device and removing the printed product while stably holding the printed product.

BRIEF SUMMARY OF THE INVENTION

The present invention provides a gripping device for gripping a printed product including a rotatable first arm having a first gripper pad and a pivot; a rotatable second arm having a second gripper pad and a pivot; a first link connecting the first gripper arm and second gripper arm, and a second link having a spring connected to the first link. A method is also provided.

Grippers may be limited in their ability to grip products with varying thicknesses before a change in setup is required. By advantageously providing a gripping device with a spring link compensating for varying thickness in products, the gripper can grip a single sheet of paper to a book 0.5 inches thick without adjustments or changes in setup.

Furthermore, the clamping force of the gripper may increase as the product thickness increases, allowing the gripper to transport a thicker product.

The present invention also provides a method for gripping a printed product including the steps of:

rotating a first gripper arm having a first gripper pad and a pivot;

rotating a second gripper arm having a second gripper pad and a pivot;

moving a first link downward or upward to open or close the gripper arms;

moving a second link having a spring in the same direction as the first link; and moving the first and second gripper pads downwardly to grip a printed product;

the second link being connected to the first link.

BRIEF DESCRIPTION OF THE DRAWINGS

A preferred embodiment of the present invention will be elucidated with reference to the drawings, in which.

DETAILED DESCRIPTION OF A PREFERRED EMBODIMENT

Figure 1:
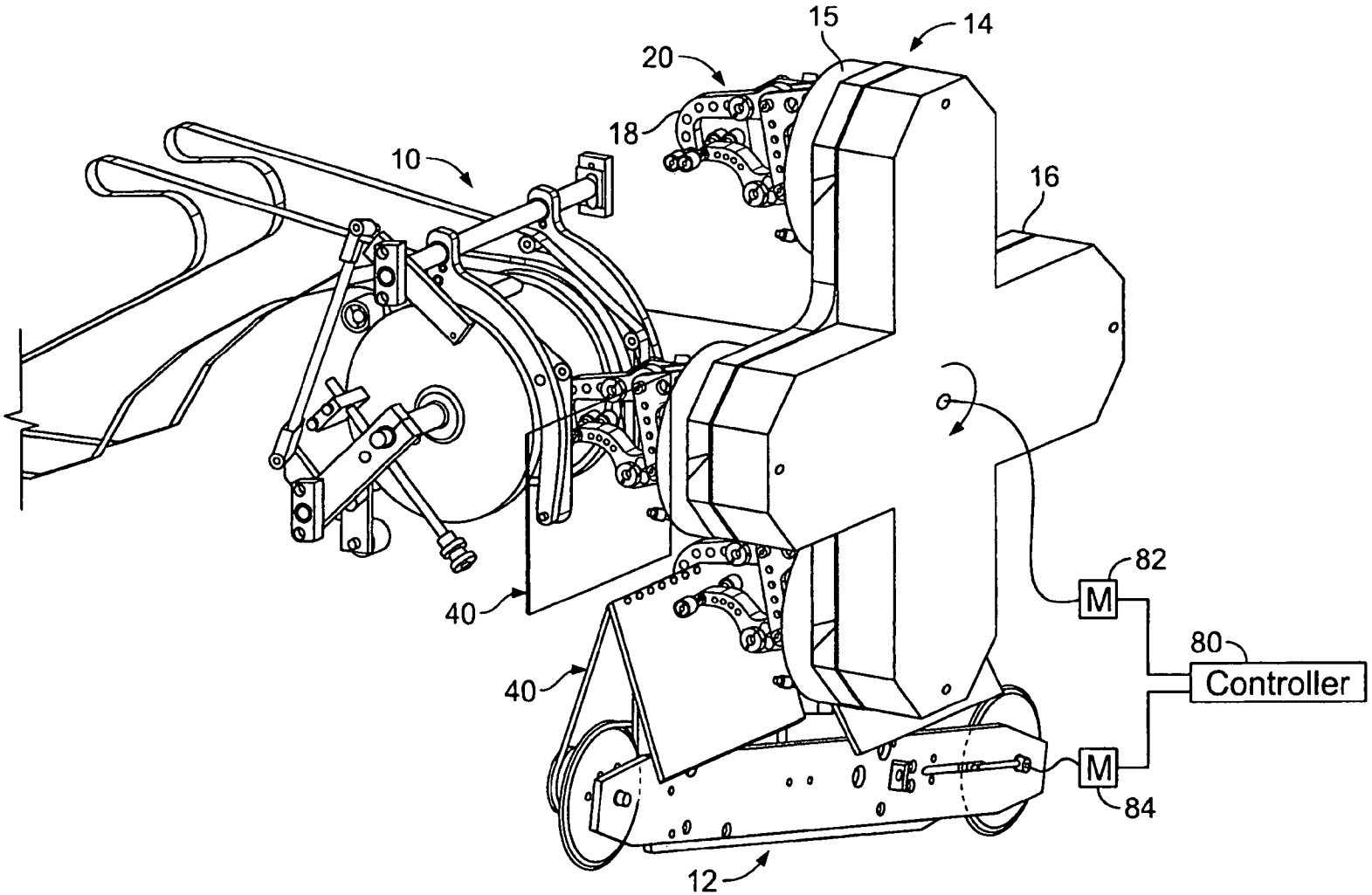
FIG. 1 shows a gripping device according to the present invention.

FIG. 1 shows a preferred embodiment of a gripping device 14 having gripper arms 16 with gripper bases 15. A gripper 20 is mounted on each base 15 in such a way to allow grippers 20 to rotate as gripper device 14 rotates. Thus, grippers 20 maintain an upright position 18 as gripper device 14 rotates clockwise.

As a printed product 40 is transported along an escalator tucker 12, escalator tucker 12 lifts printed product 40 up to be gripped by grippers 20. Gripper device 14 is timed with escalator tucker 12 via a controller 80 controlling individually driven servo motors 82, 84, although the escalator tucker 12 could be geared to gripping device 14 as well. Gripper 20 removes printed product 40 from escalator tucker 12 and delivers printed product 40 to delivery conveyor 10. Delivery conveyor 10 transports printed product 40 further along. Escalator tucker 12 may be similar to the signature transport device disclosed in U.S. Patent Application Publication No. 2005/0225023, hereby incorporated by reference herein.

Figure 2:
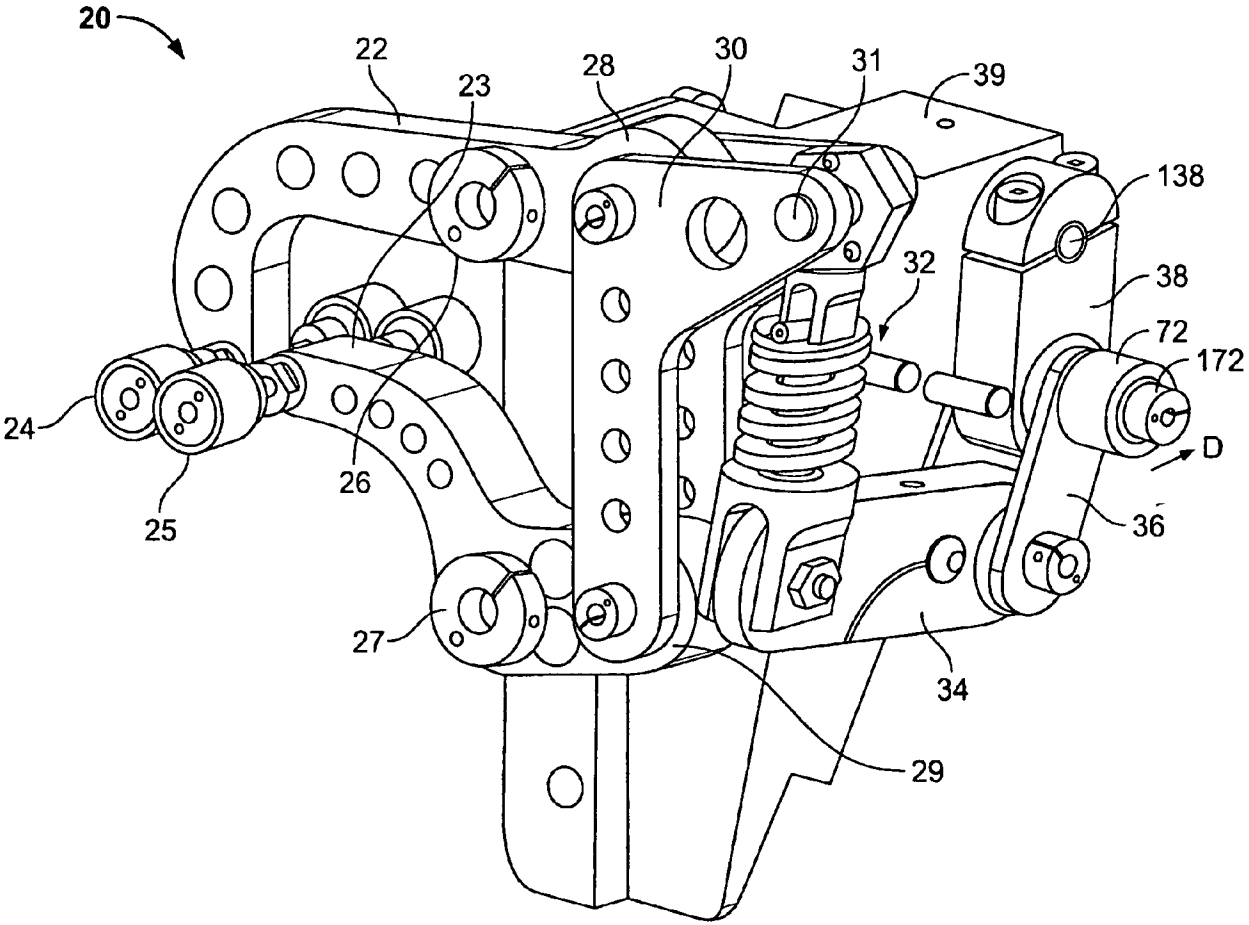
FIG. 2 shows a gripper of the gripping device.

FIG. 2 shows a gripper 20 from gripping device 14. Gripper 20 includes gripper arms 22, 23 having gripper pads 24, 25 and pivots 26, 27 respectively. One end 28 of gripper arm 22 is connected to a coupler link 30, while one end 29 of gripper arm 23 is connected to another end of coupler link 30. Coupler link 30 is connected at another end 31 to a spring link 32. Spring link 32 is controlled by the movement of cam follower 72 via links 34 and 36. Link 38 pivotally supports cam follower 72 via a pin 172.

The gripper 20 is spring-loaded in an open position, for example, by a cam spring forcing link 30 downwardly in FIG. 2 by forcing link 38 in a direction D. When cam follower 72 is forced opposite direction D, link 38 moves against the cam spring force rotating about a pivot 138, pushing link 34 via link 36 to counteract the cam spring force and force the entire spring link 32 upwardly. When spring link 32 moves upward, coupler link 30 moves upward and ends 28, 29 are pushed upward. Thus, gripper 20 closes as gripper arms 22, 23 rotate around pivots 26, 27.

Figure 3:
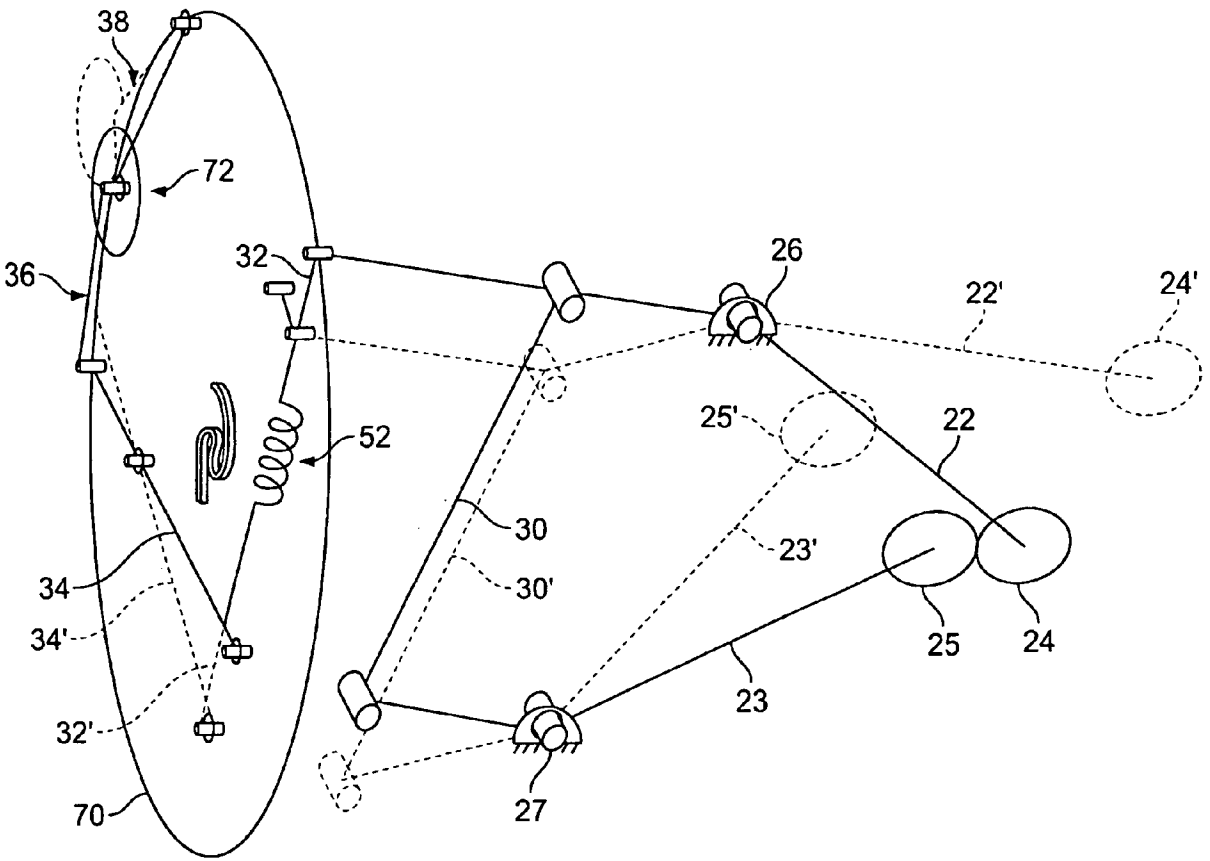
FIG. 3 shows a schematic view of the gripping device.

FIG. 3 shows a schematic of the actuation of gripper 20. When gripper 20 is closed, (solid lines, high cam dwell) upper arm 22 with gripper pad 24 is contacting lower arm 23 with gripper pad 25. As cam follower 72 follows cam 70 to a low dwell, links 38, 36, via the cam spring, move causing link 34 to move into position 34'. Link 34 actuates spring link 32, by pulling spring link 32 downward into position 32'. Spring link 32 pulls coupler link 30 downward into position 30' causing upper arm 22 to rotate open around pivot 26 and lower arm 23 to rotate open around pivot 27. Upper arm rotates into position 22' with gripper pad 24' while lower arm rotates into position 23' with gripper pad 25'.

Figure 4A:
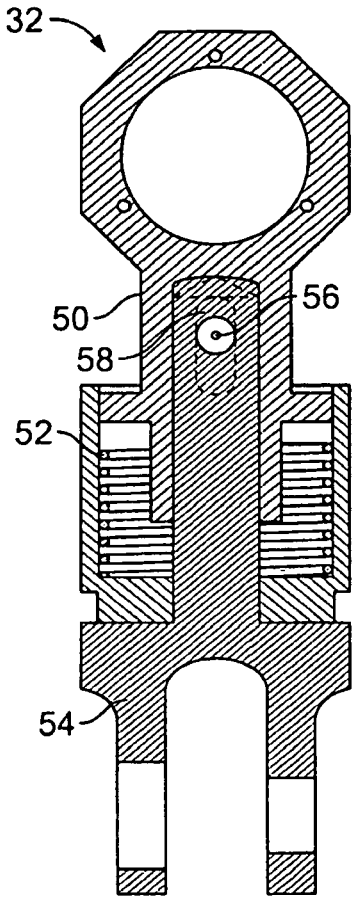
FIGS. 4A and 4B show a spring link of the gripper.
Figure 4B:
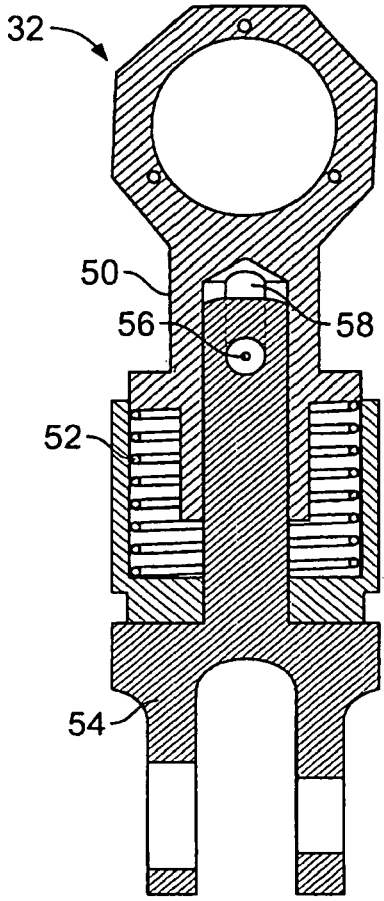

Spring 52 can compensate for product thickness. FIG. 4A shows spring link 32 in a compressed position when gripper 20 is in a closed position gripping a product 40. FIG. 4B shows spring link 32 in an uncompressed position, which corresponds to when gripper 20 does not grip a product 40. Spring link 32 includes two sliding links 50 and 54 and a spring 52. A dowel 56, fixed to link 54, slides in a slot 58 in link 50. When spring link 32 is in the uncompressed position, link 50 is forced away from link 54 so dowel 56 contacts a base of slot 58. When link 50 faces resistances from a gripped product, slot 58 permits movement of link 50 downward with respect to link 54 compressing spring 52.

Spring link 32 thus moves in two ways. Spring link 32 moves as a whole when gripper jaw 21 opens and closes before a product is gripped. Spring link 32 also compresses to accommodate thickness of a printed product 40.

Link 34 moves in direction D and pulls spring link 32 downward as gripper 20 opens. (See FIG. 2). When dowel 56 rests at the base of slot 58, links 50, 54 and spring 52 move downward when spring link 32 is pulled downward. Thus, when link 54 is pulled downward, link 50 is also pulled downward and gripper 20 opens.

As gripper jaw 21 closes, link 34 moves in a direction opposite direction D and pushes spring link 32 upward. (See FIG. 2). From the FIG. 4B position, link 54 and dowel 56, as well as link 50 via spring 52, move upwardly until the printed product is gripped since there is no resistance at the gripper jaw 21. At the point of gripping, a resistance at link 50 from the printed product causes spring 52 to compress. When gripper pads 24, 25 grip a printed product 40, gripper arms 22, 23 remain rotated about pivots 26, 27. Subsequently, ends 28, 29 push coupler link 30 downward so spring link 32 is pushed downward by coupler link 30 and upward by link 34. To compensate for this, sliding link 50 slides downward into link 54 compressing spring 52 shown in the FIG. 4A position.

The term "thick printed product" is defined as a printed product 0.5" thick or greater although the present invention is not only applicable to thick printed products.

What is claimed is:

1. A printed product conveyor comprising a plurality of grippers for gripping a printed product each gripper including:

a rotatable first gripper arm having a first gripper pad and a pivot;

a rotatable second gripper arm having a second gripper pad and a pivot;

a first link rigidly connecting the first gripper arm and second gripper arm; and a second link having a spring, the second link connected to the first link;

the first and second gripper pads gripping a printed product, the second link including a dowel and a plurality of sliding links, wherein the second link moves upward and the first link resists movement upward so a first sliding link compresses the spring due to resistance from the first link.

2. A method for gripping a printed product comprising the steps of:

conveying a printed product via a signature transport device;

rotating a first gripper arm having a first gripper pad and a pivot, the rotating occurring via a motor timed to the signature transport device;

rotating a second gripper arm having a second gripper pad and a pivot;

moving a first link downward or upward to open or close the gripper arms;

moving a second link having a spring in the same direction as the first link; and moving the first and second gripper pads downwardly to grip the printed product being conveyed on the signature transport device;

the second link being connected to the first link, the second link compensating for different thicknesses in printed products.

3. The method as recited in claim 2 further comprising the step of transporting a folded printed product.

4. A method for gripping a printed product comprising the steps of:

conveying a printed product via a signature transport device;

rotating a first gripper arm having a first gripper pad and a pivot, the rotating occurring via a motor timed to the signature transport device;

rotating a second gripper arm having a second gripper pad and a pivot;

moving a first link downward or upward to open or close the gripper arms;

moving a second link having a spring in the same direction as the first link, the second link being connected to the first link, the second link compensating for different thicknesses in printed products;

moving the first and second gripper pads downwardly to grip the printed product being conveyed on the signature transport device; and compressing the spring as the first and second gripper pads move downwardly to grip printed product.

5. A method for gripping a printed product comprising the steps of:

rotating a first gripper arm having a first gripper pad and a pivot;

rotating a second gripper arm having a second gripper pad and a pivot;

moving a first link downward or upward to open or close the gripper arms;

moving a second link having a spring in the same direction as the first link; and moving the first and second gripper pads downwardly to grip a printed product;

the second link being connected to the first link, sliding the second link upwardly as the first and second gripper pads grip a printed product;

sliding a first sliding link of the second link downwardly; and compressing the spring of the second link.

6. A saddle stitcher comprising:

a plurality of grippers for gripping a printed product; and an escalator tucker for lifting the printed product up to be gripped by the grippers, the escalator tucker being geared to the plurality of grippers, each gripper including:

a rotatable first gripper arm having a first gripper pad and a pivot;

a rotatable second gripper arm having a second gripper pad and a pivot;

a first link rigidly connecting the first gripper arm and second gripper arm; and a second link having a spring, the second link connected to the first link, the second link compensating for different thicknesses in printed products;

the first and second gripper pads gripping a printed product.

7. A method for gripping a printed product comprising the steps of:

conveying a printed product via a signature transport device;

rotating a first gripper arm having a first gripper pad and a pivot, the rotating occurring via a motor timed to the signature transport device;

rotating a second gripper arm having a second gripper pad and a pivot;

moving a first link downward or upward to open or close the gripper arms;

moving a second link having a spring in the same direction as the first link; and moving the first and second gripper pads downwardly to grip the printed product being conveyed on the signature transport device;

the second link being connected to the first link, the second link permitting gripping printed products of varying thickness without adjustment to the gripper.

* * * * *